US005708977A

United States Patent [19]

Morkunas

[11] Patent Number: 5,708,977

[45] Date of Patent: Jan. 20, 1998

[54] EXPANSION UNIT FOR CLOTHING

[76] Inventor: Dorothy Lynn Morkunas, 6186 College Ave., San Diego, Calif. 92120

[21] Appl. No.: 649,789

[22] Filed: May 17, 1996

[51] Int. Cl.[6] ..... A41D 11/00

[52] U.S. Cl. ..... 2/80; 2/269; 2/69

[58] Field of Search ..... 2/69, 70, 80, 77, 2/73–75, 78.1, 78.2, 78.3, 78.4, 79, 107, 141, 2, 227, 221, 237, 238, 408, 85, 93, 269, 94, 108, 115, 106, 105, 228

[56] References Cited

U.S. PATENT DOCUMENTS

| | | | |
|---|---|---|---|
| 2,075,414 | 3/1937 | Wheeler | 2/70 |
| 2,580,024 | 12/1951 | Hoffman | 2/70 |
| 2,714,718 | 8/1955 | Kramer | 2/70 |
| 3,025,527 | 3/1962 | Seward | 2/70 |
| 3,230,545 | 1/1966 | Galley | 2/221 |
| 4,573,218 | 3/1986 | Saggs | 2/269 |
| 4,803,740 | 2/1989 | Dawson | 2/221 |
| 5,033,127 | 7/1991 | Schmeltz | 2/269 |
| 5,170,505 | 12/1992 | Rohrer | 2/69 |
| 5,367,709 | 11/1994 | Teasley | 2/69 |

*Primary Examiner*—Gloria Hale
*Attorney, Agent, or Firm*—Frank G. Morkunas

[57] ABSTRACT

An expansion unit for clothing generally having seams. The unit is of a one-piece construction and is generally located on one seam-side of a garment; the other seam-side of the garment being the receiving end of an expander section associated with the expansion unit. The expansion unit is bi-directional in scope and easily and effortlessly contracts and expands as needed. In the preferred embodiment, in either state, a single seam is exposed while no component of the expansion unit is plainly visible. In the contracted state, the expander section is retained and hidden from view under the clothing worn. In the expanded state, the expander section is exposed and coupled to the opposite seam-side of a garment. All pieces are removably held in place by fasteners of the hook-and-loop type, snap type, button type, hook-and-eye type, and zipper type.

12 Claims, 2 Drawing Sheets

EXPANSION UNIT FOR CLOTHING

BACKGROUND OF THE INVENTION

This invention relates to an expansion unit, specifically to an expansion unit for clothing. Use of this unit in strategic locations on clothing permits enlargement of the garment (for a baby who grows or an individual who gains weight) or contraction of the garment (for a parent's second, or subsequent, child or for an individual who loses weight).

Generally, when a person grows the garment is either discarded or, if suitable, brought to a tailor for alteration. In the case of infants, generally tailoring was not a viable alternative. In any event, discarding or tailoring is costly. Tailoring is also time-consuming. Attempts have been successfully made to increase the useful life of a garment which has been outgrown. Several of the more successful are found in Wheeler's patent for a 'Garment' (2,075, 414); Hoffmans's patent for an 'Adjustable Garment for Children' (2,580,024); Kramer's patent for an 'Adjustable Garment' (2,714,718); and Rohrer's patent for 'Expandable Children Clothing' (5,170,505). These are all creative, well-thought-out concepts which are suited for their intended purpose.

Wheeler's patent provides for an overlap of material, held in place by removable stitching, which, when the stitching is removed, the overlapped material is released and provides for expansion. It can be placed in a variety of strategic locations suited for expansion (shoulders, sleeves, collar, chest, cuffs, waist, crotch, inseam, and the like). This expansion concept, however, is uni-directional and, as a result, cannot readily contract. Once the removable stitching is removed and the overlapped material released, contraction requires the aid of a tailor.

Hoffman's patent provides for an insert which attaches to one piece of a garment on one end and to another piece of garment on another end. All elements (garment pieces and insert) must have cooperating fasteners. This adjustable unit is bi-directional and requires unfastening one garment piece from the insert and re-fastening that garment piece to a different location on the insert (one direction is for expansion and the opposite direction is for contraction). This is a versatile unit which is relatively easy to use. When used, however, the expansion elements associated with this invention become visible and can detract from the garment's appearance.

Kramer's patent, like that of Hoffman's, provides for an insert piece in between two garment sections or pieces. This insert contains a series of strips. The strips are in different locations on the insert and provide the means for expandability (contractibility). The insert attaches on one garment section. The other garment section attaches adjustably to a selected strip. On what strip a garment section is placed will depend on whether the overall garment is to be expanded or contracted. Although bi-directional, this expandable garment and its insert are best suited for use in the waist and chest. It is not suited for other locations of growth such as in the crotch, inseam, shoulders, and sleeve. Also, as in Hoffman's patent, the expansion elements (series of strips) are exposed when in use and can detract from the garment's overall appearance.

Rohrer's patent provides for a built-in three flap arrangement as the expansion means whereby an outer and an inner flap are connected together at one end in an open-and-close gripping relationship. This unit is attached to one section of a garment. Attached to a corresponding section of garment is the third flap which inserts into, and is held by, the gripping flaps. The expansion and contraction of the garment depends on the insertion point of the third flap into the gripping flaps. This is a bi-directional expansion unit which is suited for most strategic expansion points. In its contracted state, the garment's appearance is normal. When expanded, however, the insert extension fasteners become visible and can detract from the garment's appearance.

Though these prior art expansion units function well, some are cumbersome to use, some are uni-directional, none is of a single piece construction associated with the respective garment which prevents loss of a piece of the expansion unit, not all can associate with all the strategic expansion points, and not all conceal the expansion elements from view when in use. The present invention overcomes all these deficiencies and provides for a single-piece expansion unit, which is versatile and easy to use, inexpensive to incorporate into any garment, provides for comfort when in use, and does not expose the expansion elements to plain view whether in a contracted stated or an expanded state.

SUMMARY OF THE INVENTION

The above-noted problems, among others, are overcome by the present invention. This invention comprises a first garment section having a first garment end, a second garment section having a second garment section end, an expander section affixed to said second garment section end, means for removably connecting said first garment section to said second garment section, and means for removably engaging said expander section onto said first garment section.

In particular, this invention provides for a single-piece expansion unit associated with any garment generally in areas where seams are placed. This single-piece structure provides for ease of use, ease and comfort of wear, and concealment of all expansion elements.

Accordingly, several objects and advantages of my invention are:

- bi-directional application of the expansion unit; i.e., expands and contracts;
- incorporation of the expansion unit directly into the associated garment;
- concealment of the expansion unit elements from plain view in its expanded state and its contracted state;
- ease, quickness, and versatility of use;
- relative inexpense of associating the expansion unit with a garment;
- accommodate greater expansion lengths; and
- accommodate a greater number of locations to expand.

Other objects and features of the invention will become apparent as the drawings which follow are understood by reading the corresponding description thereof.

BRIEF DESCRIPTION OF THE DRAWING FIGURES

Figure 3:
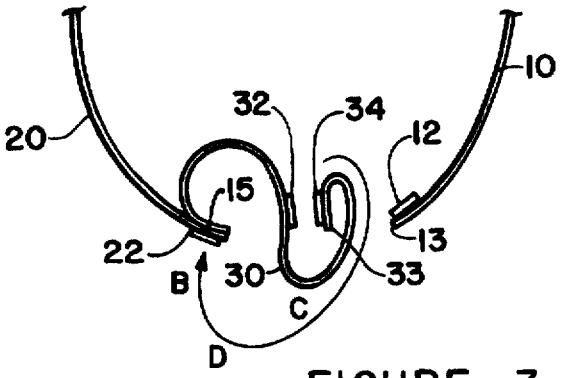
FIG. 3 shows the expansion process of FIG. 2.
Figure 4:
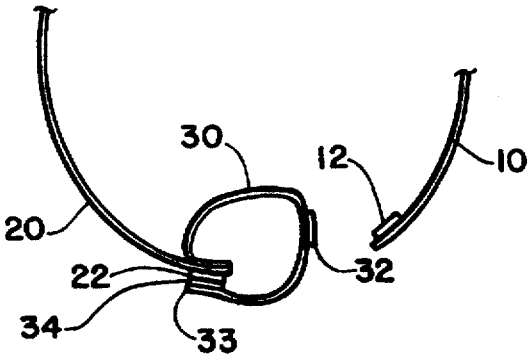

FIG. 4 continues with the expansion process shown in FIG. 3.

Figure 5:
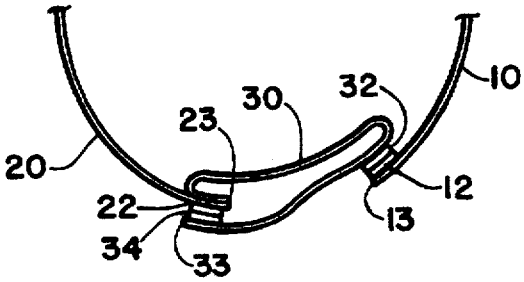

FIG. 5 shows the result of the expansion process.

Figure 1:
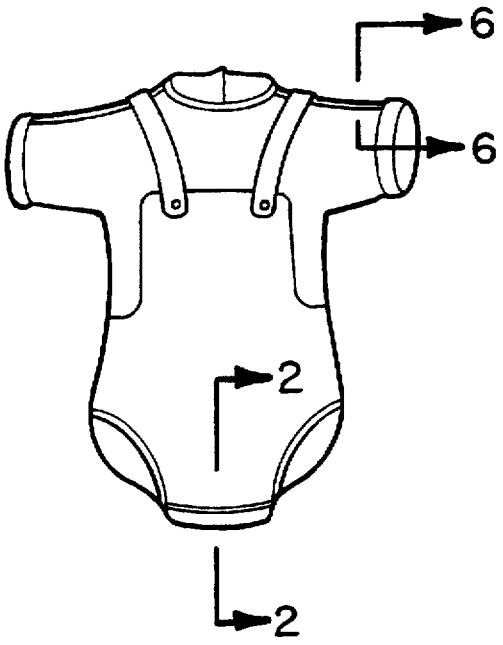
FIG. 1 is a typical garment.
Figure 6:
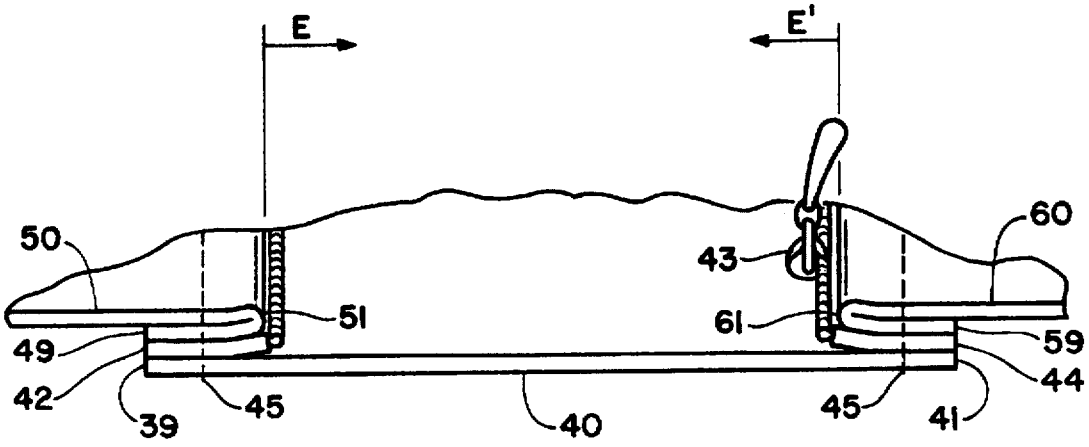

FIG. 6 taken on line 6—6 of FIG. 1, shows another embodiment of the expansion unit in its expanded state.

Figure 7:
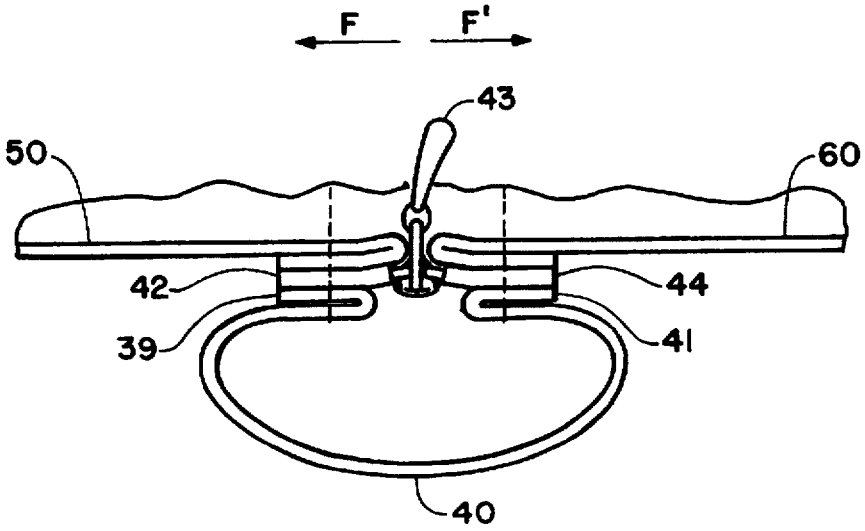

FIG. 7 shows the expansion unit from FIG. 6 in its contracted state.

Figure 8:
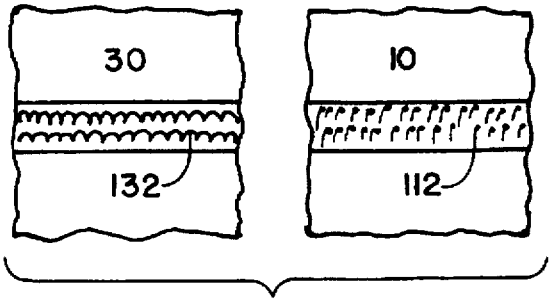

FIG. 8 shows one embodiment of connector.

Figure 9:
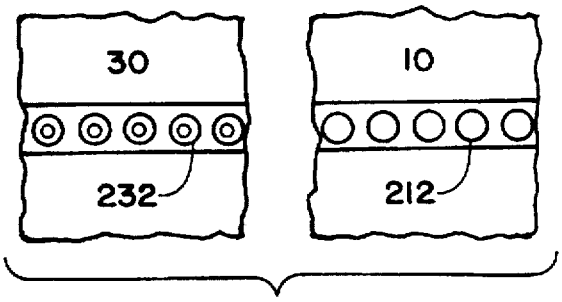

FIG. 9 shows another embodiment of connector.

DETAILED DESCRIPTION OF THE PREFERRED EMBODIMENTS

First garment section 10 and second garment section 20 relate to any garment sections where seams are generally placed and fixedly held together by thread. On first garment section 10 at first garment section end 13 is first garment section connector 12. Second garment section 20 is adjacent to first garment section 10. Second garment section 20 has second garment section connector 22 at second garment section end 23. Attached to second garment section end 23 by holding means 15 is expander section 30. Holding means 15 can permanently retain expander section 30 to second garment section 20 or such retention could be temporary and removable through use of cooperating type fasteners. Preferably such retention is permanent and by means of stitching.

Expander section 30 has expander retainer 34 at or near expander section end 33. Intermediate to expander section end 33 and holding means 15 is expander connector 32. In its contracted state, the expansion unit for clothing has first garment section 10 attached to second garment section 20 with first garment section connector 12 removably connected to second garment section connector 22. Any cooperating connecting means suited for the intended purpose may be utilized. Typical fasteners include hook-and-loop 112 and 132, snap-type 212 and 232, buttons, and hook-and-eye. Hook-and-loop fasteners are preferred (see FIG. 8). While so connected, expander section 30 remains inside the garment being worn. Expander section end 33 is at least twice folded such that expander retainer 34 and expander connector 32 are adjacent one another and removably connected. Any cooperating connecting means suited for the intended purpose may be utilized. Typical fasteners include hook-and-loop, snap-type, button, and hook-and-eye. Hook-and-loop fasteners are preferred. The length of expander section 30 can vary from about one-half inch to about twenty inches, depending of the width of expansion desired. A good workable range is from about one-half inch to about eight inches. Preferred ranges is from about one inch to about four inches.

The location of expander connector 32 can be anywhere on expander section 30 between expander retainer 34 and holding means 15. It's location will determine the length of expansion available. With expander connector 32 placed closer to expander retainer 34, less expansion length will result. Placing expander connector 32 further from expander retainer 34, up to, but not passed, expander mid-point 35 (a point substantially midway between expander section end 33 and holding means 15) will result in greater expansion length. Exceeding expander mid-point 35 will decrease the expansion length and cause an unwanted and unsightly bulging on the outer surface of the garment between expander connector 32 and expander retainer 34.

When first garment section 10 and second garment section 20 are so connected, a fine seam is formed. Expander section 30 lies unobtrusively and comfortably under the surface of the clothing worn.

Figure 2:
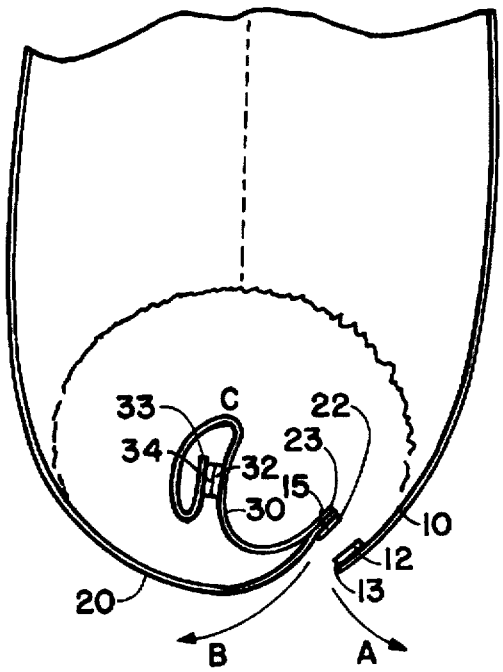
FIG. 2 is cross-section view taken on line 2—2 showing expansion unit is a contracted state.

To expand the clothing, first garment section 10 is moved in the direction of arrow A in FIG. 2. Next second garment section 20 is moved in the direction of arrow B, followed by movement of third garment section 30 (located at point C of FIG. 2) in the direction of arrow D of FIG. 3. Expander retainer 34 is then connected to second garment section connector 22; and thereafter expander connector 32 is connected to first garment section connector 12. The resulting configuration is shown in FIG. 5, the expanded state. With expander retainer 34 connected to second garment section connector 22, these connecting means are hidden from view. Exposed in this process is expander connector 32 which is brought adjacent to first garment section connector 12 and connected thereto. All connecting means are concealed and the clothing is expanded. To contract the clothing the process is reversed.

Yet another embodiment of the expansion unit is shown in FIGS. 6 and 7. FIG. 6 is the expanded mode and FIG. 7 is the contracted mode. Returning to FIG. 6, first garment piece 50 has first garment piece end 49 folded under first garment piece 50 thereby forming first garment piece abutting end 51. Similarly, second garment piece 60 has second garment piece end 59 folded under second garment piece 60 thereby forming second garment piece abutting end 61. Adjacent to the respective abutting ends 51 and 61 is first coupler 42 and second coupler 44. Said couplers cooperate with one another to removably couple first garment piece 50 to second garment piece 60 such that, when so coupled, first garment piece abutting end 51 and second garment piece abutting end 60 conceal said respective couplers. Said coupling means can be of any type cooperating fastener suited for the intended purpose. Such fasteners include zipper 43, hook-and-loop 112 and 132, snap-type 212 and 232, button, and hook-and-eye. The preferred fastener for this embodiment is zipper. In this embodiment, zipper head 43 engages first coupler 42 to second coupler 44. Expansion piece 40 is affixed to first garment piece 50 and second garment piece 60, along with first and second couplers 42 and 44, by expansion piece holding means 45. When all such elements are retained by holdings means 45, a substantially flat surface results. Expansion piece holding means 45 could be of a temporary or permanent nature. The preferred embodiment is permanent and could use stitching for that purpose.

FIG. 6 is the expanded mode. When zipper head 43 engages first and second couplers 42 and 44, first garment piece 50 and second garment piece 60 move in the direction of arrows E and E'. Expansion piece follows the movement and is concealed from the outside by first garment piece abutting end 51 and second garment piece abutting end 61. Also well concealed are first and second couplers 42 and 44 and zipper head 43. Expansion piece lies unobtrusively and comfortably on the inside of the clothing.

FIG. 7 is the contracted mode which results from the action and movement described above. The process is reversed to expand the clothing. Respective abutting ends 51 and 61 are moved apart, zipper head 43 is located, and first and second couplers 42 and 44 are uncoupled thereby permitting expansion in the direction of arrows F and F'.

Expansion piece 40 can range in length from about one-half inch in length to about twenty inches in length. A range of about one-half inch to about eight inches works well with this embodiment. The preferred ranges is from about one to four inches.

In either embodiment disclosed, the expansion unit is suited for use with all types of garments which generally have seams or joints. The expansion unit is fitted into, and becomes part of, the seam of the garment with which it is associated. Preferred locations include, but are not limited to, collar, shoulder, yoke, sleeve, chest, side seams, waist, inseam, outseam, cuffs, and crotch.

While specific embodiments of the claimed invention have been shown and fully explained above for the purpose of illustration, it should be understood that many other uses will be found for the instant invention disclosure and many alterations, modifications, and substitutions may be made thereto without departing from the spirit and scope of the invention as defined by the appended claims. Such are intended to be included within the scope of the invention. Accordingly, the scope of the invention should be determined not by the embodiments illustrated, but by the appended claims and their legal equivalents.

The invention claimed is:

1. An expansion unit for clothing having a first section and a second section, said expansion unit comprising:

a first garment section having a first garment section end at a seam location and a first garment section connector inside said first garment section;

a second garment section having a second garment section end at a seam location and a second garment section connector outside said second garment section;

an expander section affixed to said second garment section end at a seam location, said expander section having an expander mid-point and an expander connector inside said expander section substantially at said expander mid-point, and further having an expander section end and an expander retainer outside said expander section substantially at said expander section end; and means for removably connecting said first garment section by said first garment section connector to said second garment section by said second garment section connector in a non-expanded mode and, in an expanded mode, for removably connecting said expander section by said expander connector onto said first garment section at said first garment section connecter at a seam location while said expander retainer and said second garment section connector are also connected, whereby, when said first garment section is disengaged from said second garment section, said expander section becomes exposed and is connected to said first garment section thereby expanding said clothing in a seam-to-seam manner to accommodate increased growth of a wearer.

2. The invention as described in claim 1 further having a means for removably retaining said expander section end at said expander connector onto a portion of said expander section at said expander retainer while said expander section is in a non-expanded mode.

3. The invention as described in claim 1 wherein said expander section is permanently affixed to said second garment section end.

4. The invention as described in claim 1 wherein said connecting means comprise a fastener selected from a group consisting of hook-and-loop, snap, button, hook-and-eye, and zipper suited to removably connect the respective sections to which attached.

5. The invention as described in claim 1 wherein said connecting means is positioned substantially at said first garment section end, substantially at said second garment section end, and substantially at said expander mid-point, a location substantially intermediate of said expander retainer means and said second garment section end.

6. The invention as described in claim 2 wherein said retaining means comprise a fastener selected from a group consisting of hook-and-loop, snap, button, hook-and-eye, and zipper suited to removably retain said expander section onto said portion of expander section.

7. The invention as described in claim 2 wherein said retaining means is positioned substantially at said expander section end.

8. An expansion unit for clothing having a first section and a second section, said expansion unit comprising:

a separate expansion piece having an expansion piece first end and an expansion piece second end;

a first garment piece affixed to said expansion piece at a seam location, said first garment piece having a first garment piece end folded under said first garment piece first end thereby forming a first garment piece abutting end;

a second garment piece affixed to said expansion piece at a seam location, said second garment piece having a second garment piece end folded under said second garment piece second end thereby forming a second garment piece abutting end; and means for removably coupling and uncoupling said first garment piece to and from said second garment piece in a seam-to-seam fashion such that said coupling contracts said expansion piece and uncoupling expands said expansion piece, said coupling means comprising a first coupler affixed between said first garment piece end and said expansion piece first end and a second coupler affixed between said second garment piece end and said expansion piece second end, each of which are covered by said respective abutting ends.

9. The invention as described in claim 8 wherein said first garment piece and said second garment piece are each permanently affixed to said expansion piece.

10. The invention as described in claim 8 wherein said coupling and uncoupling means comprise a fastener selected from a group consisting of zipper, hook-and-loop, snap, button, and hook-and-eye suited to couple and uncouple said first garment piece to said second garment piece.

11. The invention as described in claim 8 wherein said first garment piece abutting end and said second garment piece abutting end abut and conceal said coupling means and said expansion piece when said coupler means coupling said first garment piece to said second garment piece.

12. The invention as described in claim 8 wherein said first garment piece end is folded under said first garment piece, said coupling means is adjacent thereto, and said expansion piece first end is adjacent to said coupling means, each permanently affixed in such arrangement as to form a substantially flat surface, and said second garment piece end is folded under said second garment piece, said coupling means is adjacent thereto, and said expansion piece second end is adjacent to said coupling means, each permanently affixed in such arrangement, as to form a substantially flat surface.

* * * * *